US005256086A

United States Patent [19]

Ponn

[11] Patent Number: 5,256,086

[45] Date of Patent: Oct. 26, 1993

[54] ELECTRICAL CONNECTOR SHIELD AND METHOD OF FABRICATING SAME

[75] Inventor: Timothy R. Ponn, Mentor, Ohio

[73] Assignee: Molex Incorporated, Lisle, Ill.

[21] Appl. No.: 985,786

[22] Filed: Dec. 4, 1992

[51] Int. Cl.[5] ..... H01R 13/00

[52] U.S. Cl. ..... 439/607

[58] Field of Search ..... 439/607-610

[56] References Cited

U.S. PATENT DOCUMENTS

| | | | |
|---|---|---|---|
| 4,995,834 | 2/1991 | Hasegawa | 439/620 |
| 5,037,331 | 8/1991 | Goodman et al. | 439/607 |
| 5,083,945 | 1/1992 | Miskin et al. | 439/607 |
| 5,136,119 | 8/1992 | Leyland | 174/35 R |

*Primary Examiner*—Joseph H. McGlynn

*Attorney, Agent, or Firm*—A. A. Tirva

[57] ABSTRACT

A seamless one-piece shield is provided for an electrical connector to prevent electromagnetic leakage. The connector includes a dielectric housing, with the shield substantially surrounding the housing. The shield is stamped and formed from sheet metal material and includes a base wall integrally joined to a pair of opposite side walls and a pair of opposite end walls, defining a generally box-like structure having an open side at a mating side of the connector housing opposite the base wall of the shield. The shield is void of any open seams and includes flap portions integrally joining the side walls to the end walls of the shield. Each flap portion is disposed in a folded condition against one of the side walls or the end walls of the shield.

10 Claims, 3 Drawing Sheets

ELECTRICAL CONNECTOR SHIELD AND METHOD OF FABRICATING SAME

FIELD OF THE INVENTION

This invention generally relates to the art of electrical connectors and, particularly, to a shielded connector assembly providing protection against electromagnetic interference, radio frequency interference, and the like.

BACKGROUND OF THE INVENTION

Shielded electrical connector systems are used widely in such applications as telecommunications equipment, computers and other digital information systems, and the like. The electrical circuitry in such applications include electrical cables having a plurality of electrically conductive leads surrounded and protected by an electrically conductive shield, such as a braid, foil or the like. In most such applications, it is necessary to shield the signal-carrying circuits to avoid electromagnetic interference caused by energy generated outside of as well as inside the system, and/or to avoid radio frequency interference entering the system.

Many such electrical connectors are used in conjunction with systems which incorporate printed circuit boards to which the connectors are surface-mounted or with panels having apertures through which the connectors are mounted. In fact, there are applications where individual connectors must be mounted both to a printed circuit board and through an adjacent panel. Often, both the board and the panel have ground planes or plates to which the connectors are conductively coupled. The coupling usually is through the shield of the connectors.

One type of shielded electrical connector assembly is a connector which is "box" or rectangularly shaped and includes a rectangularly shaped dielectric housing which is substantially surrounded or covered by a stamped and formed sheet metal shield Examples of such connectors are shown in U.S. Pat. Nos. 4,679,879 and 5,083,945, which are assigned to the assignee of the present invention.

Such prior art shields are manufactured by blanking, die-cutting or stamping, and forming the box-like shield, and wherein open seams result at various locations in the shield, such as at certain corners or edges of the shield. In most applications, such constructions provide adequate electromagnetic and radio frequency interference protection such that transmission of signals through the connectors are not affected However, when the electromagnetic fields are very strong, even small openings as presented by open seams in the stamped and formed shield allow leakage which may interfere with the transmission of electrical signals.

Heretofore, open seams in such shields have been closed by solder or other flowable materials. Another approach is shown in U.S. Pat. No. 5,136,119 to Leyland, dated Aug. 4, 1992. In that patent, metallized Velcro strips are used to close the open seams of a box-like shield. In shielded electrical connectors, the shields contribute considerably to the total cost of manufacturing the associated electrical connectors, and such approaches to closing open seams in the shields add still further costs and additional steps in the manufacturing process.

This invention is directed to solving the problems outlined above by providing a stamped and formed metal shield which is void of open seams, yet the shield is formed from a one-piece blank of material. No additional steps are required in fabricating the shield, other than the normal stamping and forming operations, and there are no significant increase in costs of manufacture.

SUMMARY OF THE INVENTION

An object, therefore, of the invention is to provide a new and improved shield for an electrical connector, along with a method of manufacturing the shield.

In the exemplary embodiment of the invention, a one-piece shield is provided for an electrical connector which includes a dielectric housing, with the shield substantially surrounding the housing. The shield is stamped and formed from sheet metal material and includes a base wall integrally joined to a pair of opposite side walls and a pair of opposite end walls. The resulting construction defines a generally box-like structure having an open side at a mating side of the connector housing opposite the base wall of the shield.

The invention contemplates that the shield be void of open seams and includes flap portions integrally joining the side walls to the end walls of the shield. Each flap portion is disposed in a folded condition against one of the side walls or the end walls of the shield, either on the inside or the outside of the shield structure.

In the preferred embodiment of the invention, the flap portions each are formed by a pair of juxtaposed triangular sections integrally joined to each other at a fold line, and each triangular section is integrally joined to a respective one of an adjacent side wall or end wall at a fold line. As disclosed, the flap portions are disposed in folded positions against the outside of the side walls of the shield.

The invention also contemplates a method of forming such a one-piece shield from sheet metal material by providing a blank of the sheet metal material of a size and configuration to define the side walls, end walls and base walls of the shield. Side sections and end sections of the blank are folded relative to a central section of the blank along respective fold lines to define the side walls, end walls and base wall of the shield. Corner sections of the blank are folded relative to the side sections, end sections and base section along fold lines to define the flap portions integrally joining the side walls to the end walls of the shield, and to dispose the flap portions in juxtaposition to respective ones of the side walls or the end walls of the shield. The corner sections which define the flap portions are generally rectangular, and each corner section is folded along a fold line bisecting the corner section into a pair of triangular portions.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
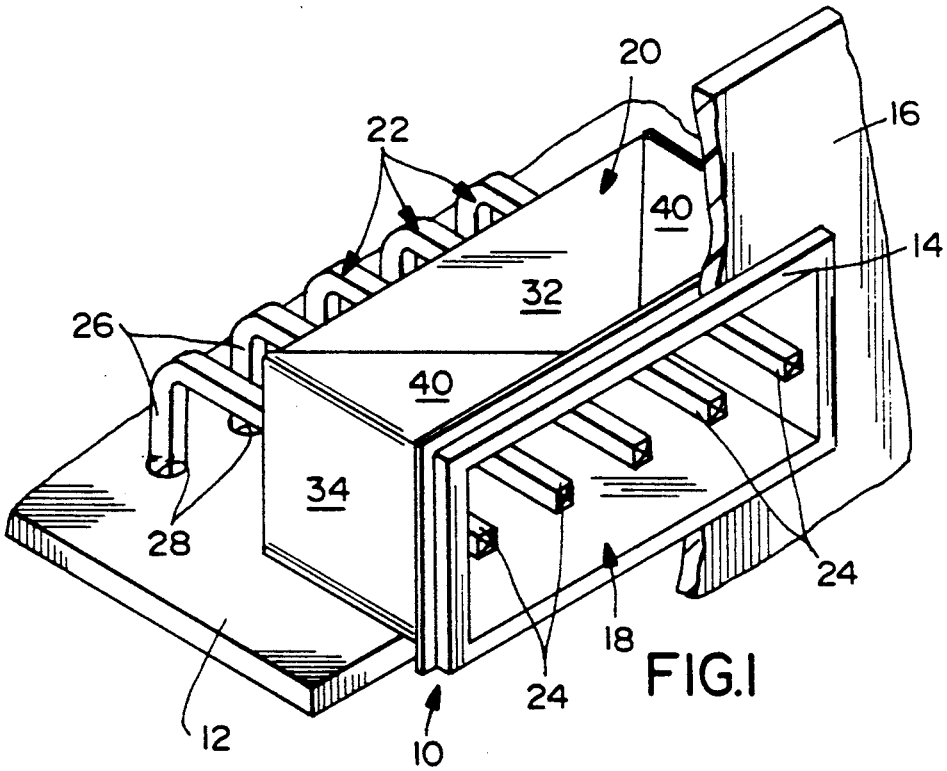
FIG. 1 is a perspective view of an electrical connector mounted to a printed circuit board and in an aperture in a panel, the connector embodying the shield of the invention.

Referring to the drawings in greater detail, and first to FIG. 1, an electrical connector, generally designated 10, is shown mounted to a surface of a printed circuit board 12, with an open front mating face 14 of the connector projecting through a panel 16. The connector includes a rectangular box-like dielectric housing, generally designated 18, substantially surrounded by a rectangular box-like shield, generally designated 20, except for the open front face 14 of the housing. The connector mounts a plurality of contact pins, generally designated 22. Each terminal includes a contact pin portion 24 located within housing 18, along with a right-angled tail portion 26 projecting out of the rear of the connector and inserted into respective holes 28 in printed circuit board 12 for establishing electrical connection to appropriate circuit traces on the board or in the holes. Contact pin portions 24 are adapted for mating with female terminals of a complementary connector (not shown) inserted into the open face of the connector.

The invention herein is directed to the structure and method of fabricating shield 20 (FIG. 1). However, it should be understood that the particular connector 10 shown in FIG. 1, along with its terminal construction and along with its mounting and application between printed circuit board 12 and panel 16 are for illustration purposes only. The structure and the method of fabricating the shield of the invention is applicable to a variety of other configurations of connectors than the particular system shown in FIG. 1.

Figure 6:
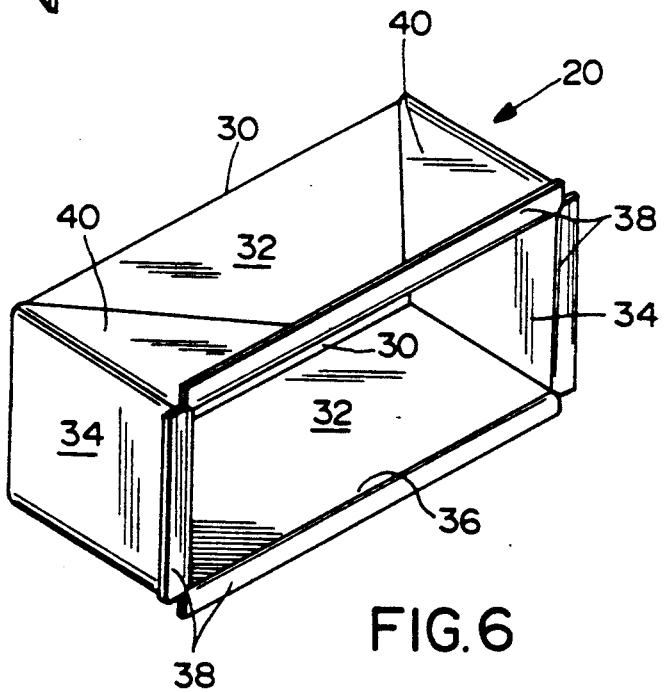
FIG. 6 is a perspective view of the final construction of the shield.

With that understanding, reference is made to FIG. 6 wherein the final structure of shield 20 is shown, as depicted in conjunction with connector 10 in FIG. 1. Specifically, the shield is stamped and formed from sheet metal material and includes a base wall 30 integrally joined to a pair of opposite side walls 32 and a pair of opposite end walls 34 to define a generally rectangular box-like structure having an open side 36. The open side of the shield is coincident with the open mating face 14 of dielectric housing 18 of connector 10 as described above in relation to FIG. 1. Flanges 38 project outwardly from side walls 32 and end walls 34, about open side 36, for abutting against the rear face of panel 16 (FIG. 1) and may engage a ground plane on the panel. However, the provision of such flanges are not intended to be limiting of the invention.

As stated above, the invention contemplates that shield 20 be void of any open seams to prevent electromagnetic leakage which may interfere with the transmission of electrical signals through the connector. To this end, and still referring to FIG. 6, shield 20 includes flap portions 40 which are integrally joined to side walls 32 and end walls 34. It can be seen that the flap portions are disposed in a folded condition against the outside of side walls 32. As will be understood from the following description of the fabrication of the shield, the flap portions could be folded against the outside of end walls 34, or the flap portions could be folded into the inside of the shield against either the side walls or end walls thereof. With the structure of shield 20 shown in FIG. 6, the shield is totally void of any open seams whatsoever, and the only access to the inside of the shield is through its open side 36 through which the complementary mating connector is inserted, the complementary connector itself most often being shielded.

Figure 2:
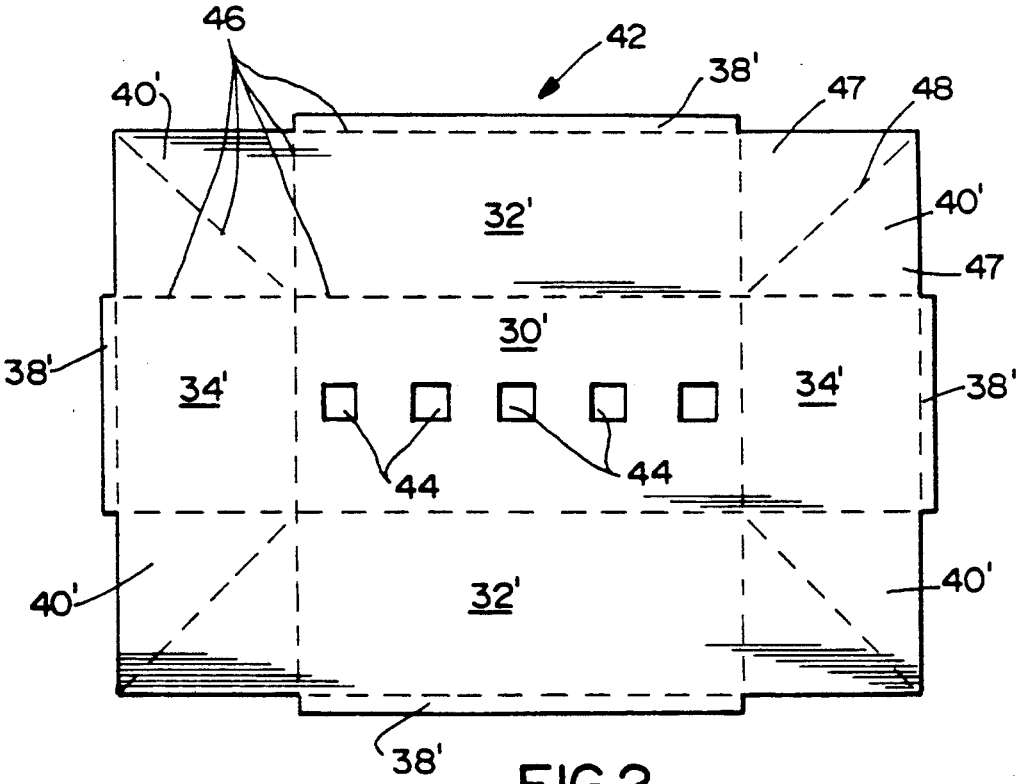
FIG. 2 is a plan view of a blank of sheet metal material from which the shield is fabricated.
Figure 3:
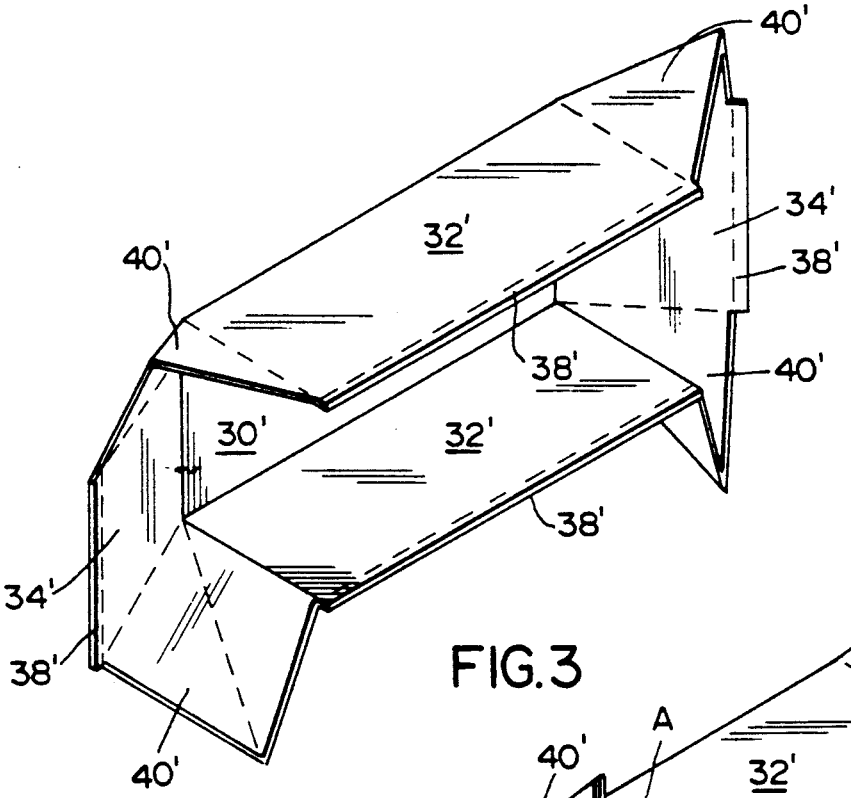
FIGS. 3-5 show sequential steps in fabricating the shield of the invention from the blank shown in FIG. 2.
Figure 4:
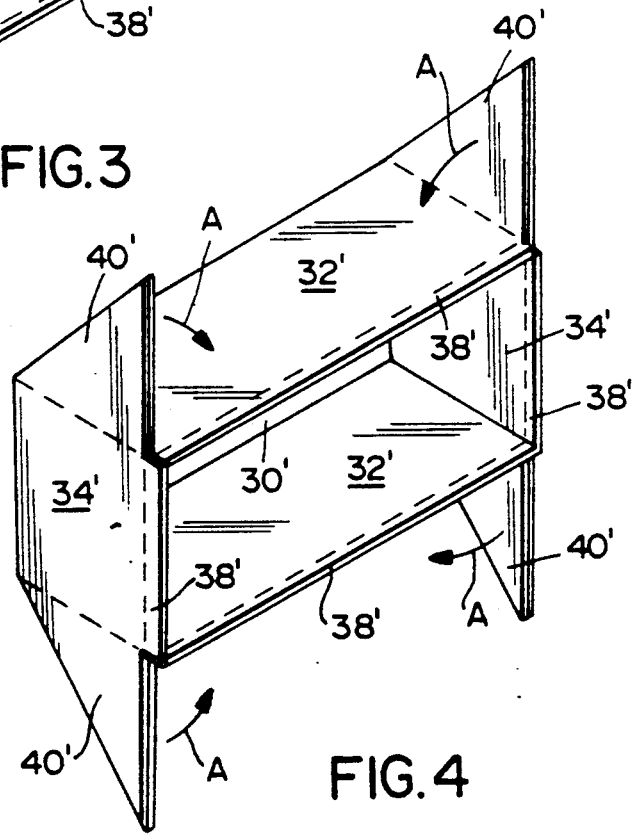
Figure 5:
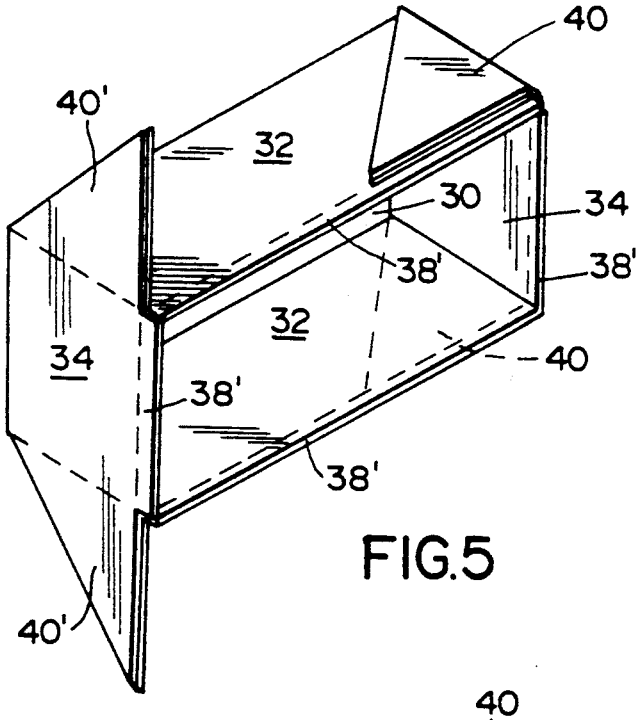

FIGS. 2-5 show sequential steps in the fabrication of shield 20 from sheet metal material. Turning first to FIG. 2, a flat blank, generally designated 42, of sheet metal material is stamped from a larger piece of the material. This blank, in its entirety, is folded as shown in FIGS. 3-5 to result in the structure of the shield shown in FIG. 6. Specifically, blank 42 includes a center section 30' which eventually forms base wall 30 of the shield; side sections 32' which eventually form side walls 32 of the shield; end sections 34' which eventually form end walls 34 of the shield; corner sections 40' which eventually form flap portions 40 of the shield; and flange sections 38' which eventually form flanges 38 of the shield. During the stamping of blank 42, holes 44 may be cut in center section 30' and through which terminals 22 (FIG. 1) eventually can protrude.

It should be noted in FIG. 2 that a plurality of dotted lines 46 are shown between center sections 30', side sections 32', end sections 34', corner sections 40' and flange sections 38' in order to provide a clear and concise understanding of the portions of blank 42 which are used to eventually form the shield structure shown in FIG. 6. In essence, the dotted lines represent fold lines which will be clearly understood with reference to FIGS. 3-5. Reference numerals have not been applied to all of the dotted lines shown in FIG. 2 in order to avoid unnecessarily cluttering the clear depiction.

Stamped blank 42 then is fed through appropriate folding or forming machines, or a single forming machine with a plurality of folding stations, to carry out the various folding operations as illustrated in FIGS. 3-6.

More particularly, referring to FIG. 3, it can be seen that side sections 32' have been folded inwardly toward each other relative to base section 30' to form side walls 32 (FIG. 6) of shield 20. During the inward folding of side sections 32', end sections 34' and corner sections 40' can be seen to be partially folded.

Referring next to FIG. 4, it can be seen that end sections 34' have been folded inwardly relative to base section 30' and the previously folded side sections 32' to form the general box-like configuration of the final shield structure. It can be seen that corner sections 40' have been partially folded but are still projecting outwardly from side sections 32' and generally coplanar with end sections 34'. End sections 34', in FIG. 4, have been folded to their final positions to form end walls 34 of shield 20 as described in relation to FIG. 6. Arrows "A" (FIG. 4) show the direction in which corner sections 40' next will be folded.

At this point, a comparison should be made between flat blank 42 shown in FIG. 2 and the partially fabricated structure shown in FIG. 4. In FIG. 2, it can be seen that corner sections 40' are generally rectangular or square in shape. Each corner section can be considered as bisectable into a pair of triangular portions 47, as indicated by dotted line 48 in the upper right-hand corner of the blank. In comparing FIG. 2 with FIG. 4, it can be seen that each rectangular corner section 40' is folded along such a bisecting fold line so that flap portions 40 (FIG. 6) eventually are triangularly shaped but void of any open seams.

Turning next to FIG. 5, it can be seen that the two corner sections (40') at the right-hand end of the partially formed shield have been folded against the outside of side walls 32 of the shield to define flap portions 40. The left-hand corner sections 40' are still shown in their outwardly projecting, unfolded condition.

The final forming steps in fabricating shield 20 can be seen by comparing FIG. 5 with FIG. 6, wherein the left-hand corner sections 40' (FIG. 5) finally have been folded against and into juxtaposition with side walls 32 of the shield, and flanges 38 have been folded or bent transversely outwardly. The shield now is completely formed and ready to be assembled about dielectric housing 18 (FIG. 1) of connector 10.

It also should be understood that corner sections 40' which are folded to form flap portions 40 of shield 20 can be folded in different directions or orientations other than that described above in relation to FIGS. 3–6. More particularly, the corner sections are shown formed or folded against the outside of the side sections or side walls 32. The corner sections similarly could be folded against the outside of end walls 34, depending upon the dimensions of the end walls and/or shield. In the particular configuration of the shield in the drawings, the end walls are relatively narrow. Therefore, if the side sections or flap portions were folded against the outside of the end walls, one flap portion would overlap the other flap portion at each end, resulting in an undue thickness or laminate. However, in wider shield structures incorporating the concepts of the invention, the corner sections could be folded to form flap portions against the outside of the end walls should the end walls be sufficiently wide to avoid overlapping the flap portions. Still further, side sections 40' equally could be folded inwardly to define flap portions which are juxtaposed against the inside of either the side walls or end walls of the shield. This can be understood by reference to FIG. 3, wherein an appropriate forming or folding machine could bias the corner sections inwardly rather than outwardly as shown. The corner sections are folded against the outside of the shield to leave a smoother interior for the shield.

By making a final comparison between flat blank 42 in FIG. 2 with the fully formed shield 20 in FIG. 6, it can be seen that the entire shield is fabricated without any open seams whatsoever through which electromagnetic leakage could occur. That is, of course, except for open end 36 for receiving the complementary mating connector, and holes 44 (FIG. 2) through which the terminals must project. After the blank is fed through the folding or forming machine or stations, no other additional fabricating steps are necessary, such as soldering, taping or otherwise closing open seams as has been done heretofore with prior shields of the character described generally herein.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a one-piece shield for an electrical connector which includes a dielectric housing with the shield substantially surrounding the housing, the shield being stamped and formed from sheet metal material and including a base wall integrally joined to a pair of opposite side walls and a pair of opposite end walls defining a generally box-like structure having an open side at a mating side of the connector housing opposite the base wall of the shield, wherein the improvement comprises said shield being void of open seams and including flap portions integrally joining the side walls to the end walls of the shield and each flap portion being disposed in a folded condition against one of the side walls and the end walls.

2. In a one-piece shield as set forth in claim 1, wherein said flap portions each comprise a pair of juxtaposed triangular portions integrally joined to each other at a fold line and each triangular portion being integrally joined to a respective one of an adjacent side wall and end wall at a fold line.

3. In a one-piece shield as set forth in claim 2, wherein said flap portions are disposed in folded positions against the side walls of the shield.

4. In a one-piece shield for at least partially surrounding a dielectric housing of an electrical connector, the shield being stamped and formed from metal material and including a base wall, at least one side wall and at least one end wall integrally joined to the base wall, wherein the improvement comprises a flap portion integrally joining the side wall and the end wall and being disposed in a folded condition in juxtaposition to one of the side wall and the end wall of the shield.

5. In a one-piece shield as set forth in claim 4, wherein said flap portion comprises a pair of overlapped triangular portions integrally joined to each other at a fold line and each triangular portion being integrally joined to one of the side wall and the end wall of the shield.

6. A method of forming a one-piece shield from sheet metal material such that the shield forms a box-like structure with a generally rectangular base wall integrally joined to a pair of generally rectangular opposite side walls and a pair of generally rectangular end walls for substantially surrounding a dielectric housing of an electrical connector, comprising the steps of:

stamping a generally rectangularly shaped blank from the sheet metal material;

folding side sections and end sections of the blank relative to a central section of the blank along respective fold lines to define the side walls, end walls and base wall, respectively, of the shield; and folding corner sections of the blank relative to the side sections, end sections and base section along fold lines to define flap portions integrally joining the side walls to the end walls of the shield and to dispose the flap portions in juxtaposition to respective ones of the side walls and the end walls of the shield.

7. The method of claim 6 wherein said side sections, end sections and corner sections all are folded relative to the center section of the blank substantially continuously.

8. The method of claim 6 wherein said corner sections are generally rectangular and each corner section is folded along a fold line bisecting the corner section into a pair of triangular portions.

9. A method of forming a one-piece shield from sheet metal material such that the shield includes at least one side wall and at least one end wall integrally joined to a base wall, comprising the steps of:

providing a blank of the sheet metal material of a size and configuration to define said side wall, end wall and base wall;

folding a side section and an end section of the blank relative to an intermediate section of the blank along respective fold lines to define the side wall, end wall and base wall, respectively, of the shield; and folding a corner section of the blank relative to the side section, end section and intermediate section to define flap portions integrally joining the side wall and the end wall of the shield and to dispose the flap portion in juxtaposition to one of the end wall and the side wall of the shield.

10. The method of claim 9 wherein said corner section is folded along a fold line generally bisecting the corner section.

* * * * *